US007207881B2

(12) United States Patent
Suverein et al.

(10) Patent No.: US 7,207,881 B2
(45) Date of Patent: Apr. 24, 2007

(54) DEVICE FOR DISPENSING DISC-SHAPED OBJECTS, SUCH AS COINS

(75) Inventors: Leonardus Albertus Patrick Suverein, Kalmthout (BE); Cornelis Martinus Suverein, Rotterdam (NL); Edwin André Roodenburg, Krimpen A/D Ijssel (NL)

(73) Assignee: Suzo International (NL) B.V., Oud-Beijerland (NL)

( * ) Notice: Subject to any disclaimer, the term of this patent is extended or adjusted under 35 U.S.C. 154(b) by 162 days.

(21) Appl. No.: 10/496,749

(22) PCT Filed: Dec. 5, 2002

(86) PCT No.: PCT/NL02/00793

§ 371 (c)(1),
(2), (4) Date: May 26, 2004

(87) PCT Pub. No.: WO03/049045

PCT Pub. Date: Jun. 12, 2003

(65) Prior Publication Data

US 2005/0176358 A1 Aug. 11, 2005

(30) Foreign Application Priority Data

Dec. 6, 2001 (NL) ..... 1019510

(51) Int. Cl.
*G07D 1/00* (2006.01)

(52) U.S. Cl. ..... 453/29

(58) Field of Classification Search ..... 453/18, 453/29, 30, 31, 32, 33, 34; 198/459.2; 221/260, 221/261

See application file for complete search history.

(56) References Cited

U.S. PATENT DOCUMENTS

| | | | | | |
|---|---|---|---|---|---|
| 3,837,454 | A | * | 9/1974 | Joeck | 194/318 |
| 4,407,312 | A | * | 10/1983 | Davila et al. | 453/32 |
| 4,544,058 | A | * | 10/1985 | Choderker et al. | 194/325 |
| 4,752,274 | A | * | 6/1988 | Abe | 453/32 |
| RE32,799 | E | * | 12/1988 | Abe | 453/32 |
| 5,066,261 | A | | 11/1991 | Parham | 453/57 |
| 5,125,493 | A | | 6/1992 | Abe | 194/344 |
| 5,181,881 | A | * | 1/1993 | Abe | 453/57 |
| 5,190,495 | A | * | 3/1993 | Taxon | 453/32 |
| 5,462,480 | A | * | 10/1995 | Suzukawa | 453/49 |
| 5,688,166 | A | * | 11/1997 | Chen | 453/57 |
| 6,283,267 | B1 | * | 9/2001 | Tanaka | 194/334 |
| 6,595,343 | B1 | * | 7/2003 | Tanaka et al. | 194/344 |
| 6,709,324 | B1 | * | 3/2004 | Beadell | 453/29 |

* cited by examiner

FOREIGN PATENT DOCUMENTS

EP 0 612 041 A1 4/1994

*Primary Examiner*—Patrick Mackey
*Assistant Examiner*—Mark J. Beauchaine
(74) *Attorney, Agent, or Firm*—Hoffmann & Baron, LLP

(57) ABSTRACT

A device for transferring a flow of disc-shaped objects, such as coins, from a reservoir to a delivery location at a higher level. This device is provided with a coin guiding passage that has its bottom positioned in an inclined plane, said passage being connected to the reservoir through a passage position that has its longitudinal axis directed substantially horizontally and merging into a position that rises towards said delivery location through a curved action of substantially 90°. To prevent coins in the curved section from jamming or blocking, an upper wall portion is provided in the curved section, on coin thickness level above the bottom of the coin guiding passage, said upper wall position being capable of yielding relative to the passage bottom and being preferably in the form of a disc.

8 Claims, 5 Drawing Sheets

DEVICE FOR DISPENSING DISC-SHAPED OBJECTS, SUCH AS COINS

CROSS-REFERENCE TO RELATED APPLICATIONS

This application is the National Stage of International Application No. PCT/NL02/00793, filed Dec. 5, 2002, which claims the benefit of Netherlands Application No. NL 1019510, filed Dec. 6, 2001, the contents of which is incorporated by reference herein.

FIELD OF THE INVENTION

The invention relates to a device for dispensing disc-shaped objects, such as coins, comprising a coin storage reservoir with an inclined rotary bottom plate and provided with a coin outlet opening, which is directed substantially tangentially relative to the top location of the bottom plate, said bottom plate being adapted to arrange the coins in the reservoir into a continuous flow of successive, flat lying coins and to push the coins from said flow, starting from the upper location of the rotary bottom plate, along a substantially straight path in a substantially horizontal direction one by one towards and through the coin outlet opening, and a conveyor for raising the coins from the level of the outlet opening of the coin storing reservoir to a delivery location.

BACKGROUND OF THE INVENTION

Such a device is disclosed by U.S. Pat. No. 5,181,881. According to this document the property of being flexible of the upper wall portion of the curved section of the coin guiding passage avoids the risk for a deformed (bent) coin to become jammed or blocked within the curved section of the through-shaped coin guiding passage under the influence of the pressure or back pressure that is applied to it by an adjacent coin. A deformed coin will be completely pushed out of the coin guiding passage.

A disadvantage of the devices above referred to is to be seen in that coins expelled as being deformed must be discharged and handled separate from other coins. This will increase costs of the device and usage. Further, the chance that a "normal" coin is unintentionally thrown out increases according to a deformed coin being expelled with more certainty. For also in case of handling only clean coins an irregular play of forces, characterized by pressure and back pressure forces of varying directions and magnitudes, will occur in the curved section of the coin guiding passage. The result of this is a shock-wise transportation of the coins through the curved section, whereby particularly in the upper part of the curved section successive coins will ultimately move apart and bump up against one another. Under these conditions even a clean coin may easily get released from the passage bottom and there will be a real chance—in case of sufficient freedom of swerving in a direction perpendicular to the passage bottom such as with the devices above described—that successive coins will get into mutually overlapping positions and will be removed unintentionally.

An object of the invention is to provide an improved coin dispensing device of the type above referred to and more particularly an improved coin movement through the curved section of the coin guiding passage, so as to increase the reliability in operation of the device, without coins being thrown out unnecessarily.

SUMMARY OF THE INVENTION

According to the invention, said object is achieved by a device for dispensing disc-shaped objects, such as coins, comprising a coin storage reservoir with an inclined rotary bottom plate and provided with a coin outlet opening which is directed substantially tangentially relative to the top location of the bottom plate, said bottom plate being adapted to arrange the coins in the reservoir into a continuous flow of successive, flat lying coins and to push the coins from said flow, starting from the upper location of the rotary bottom plate, along a substantially straight path in a substantially horizontal direction one by one towards and through the coin outlet opening, and a conveyor for raising the coins from the level of the outlet opening of the coin storing reservoir to a delivery location, said conveyor comprising a trough-shaped coin guiding passage that is substantially formed by a bottom and two opposite side walls, said passage having at its lower end a curved section that is connected with said outlet opening, said curved section being adapted to receive the flow of coins discharged through the outlet opening of said reservoir in flat on the passage bottom lying positions and to bend the received flow of coins substantially through 90° towards the raising part of the coin guiding passage, the guiding means having an upper wall portion which is provided on coin thickness level above the coin guiding passage and which is flexible relative to the passage bottom, wherein the upper wall portion is disc-shaped, and the upper wall portion is mounted for rotation about an axis which is positioned adjacent the inside bend side wall of the curved section.

When a coin forces the yielding disc to flex in the vertical direction, the braking force which is thereby applied to the coin will be kept small because the disc-shaped wall portion may also "yield" or movably guide the coin in its travel direction.

According to another feature of the invention there is provided under the disc-shaped upper wall portion, which may consist e.g. of rubber, a group of control arms which are rotatable about the axis of the upper wall portion and extend substantially radially outwardly relative to said axis, said arms extending, in operation, between the successive coins in the coin guiding passage, the inside bend side wall of the coin guiding passage having a recess for allowing rotation of the control arms through the recess. The control arms may be integrally formed with the disc-shaped upper wall and yield along with said upper wall.

In a particular embodiment the control arms constitute the teeth or blades of a separate gear or blade wheel respectively, that is adapted to be driven in synchronism with the rotary bottom plate of the coin storing reservoir. With such a gear or blade wheel, that is driven in synchronism with the rotary bottom plate of the coin storing reservoir the rotating arms or blades cause the coins in the curved section to "round the curve" in an uniform flow, thereby putting a minimum load on the drive motor of the system.

In a further particular embodiment on the axis having mounted thereon the disc-shaped upper wall section of the curved section of the coin guiding passage there is mounted a drive gear, and the rotary bottom plate of the reservoir is provided with gear teeth which engage said drive gear. This has the advantage that the disc-shaped upper wall section and, possibly, the control arms are driven in synchronism with the flow of coins avoiding collisions between coins at the curved section, the occurrence of irregular forces acting on coins and jamming of the coin guiding passage.

Preferably, a portion of the curved section of the coin guiding passage is formed by a side of the gear which is mounted on the axis. By this the occurrence of unwanted forces and friction between coins and between coins and walls of the guiding passage at its curved section are further reduced thereby reducing the risk of jamming of the coin guiding passage also.

It is to be noted that the use of a blade wheel that is driven in synchronism with the rotary bottom plate of a coin storing reservoir is known per se with a coin dispensing device according to EP document 0 204 405. With this well-known coin dispensing device the blade wheel extends with its blades into the path of the rotary bottom to divert coins from said path and carry these coins to a location on a higher level. In this case there is no guiding of coins through a curved section of a raising conveyor.

With the device of the present invention the raising part of the coin guiding passage following the curved section may be advantageously covered from one side by a covering strip that has its passage facing side planted with bristles such as described in EP document 0 950 989.

The invention will be hereinafter further explained by way of example with reference to the drawing.

DETAILED DESCRIPTION OF PREFERRED EMBODIMENTS

Figure 1:
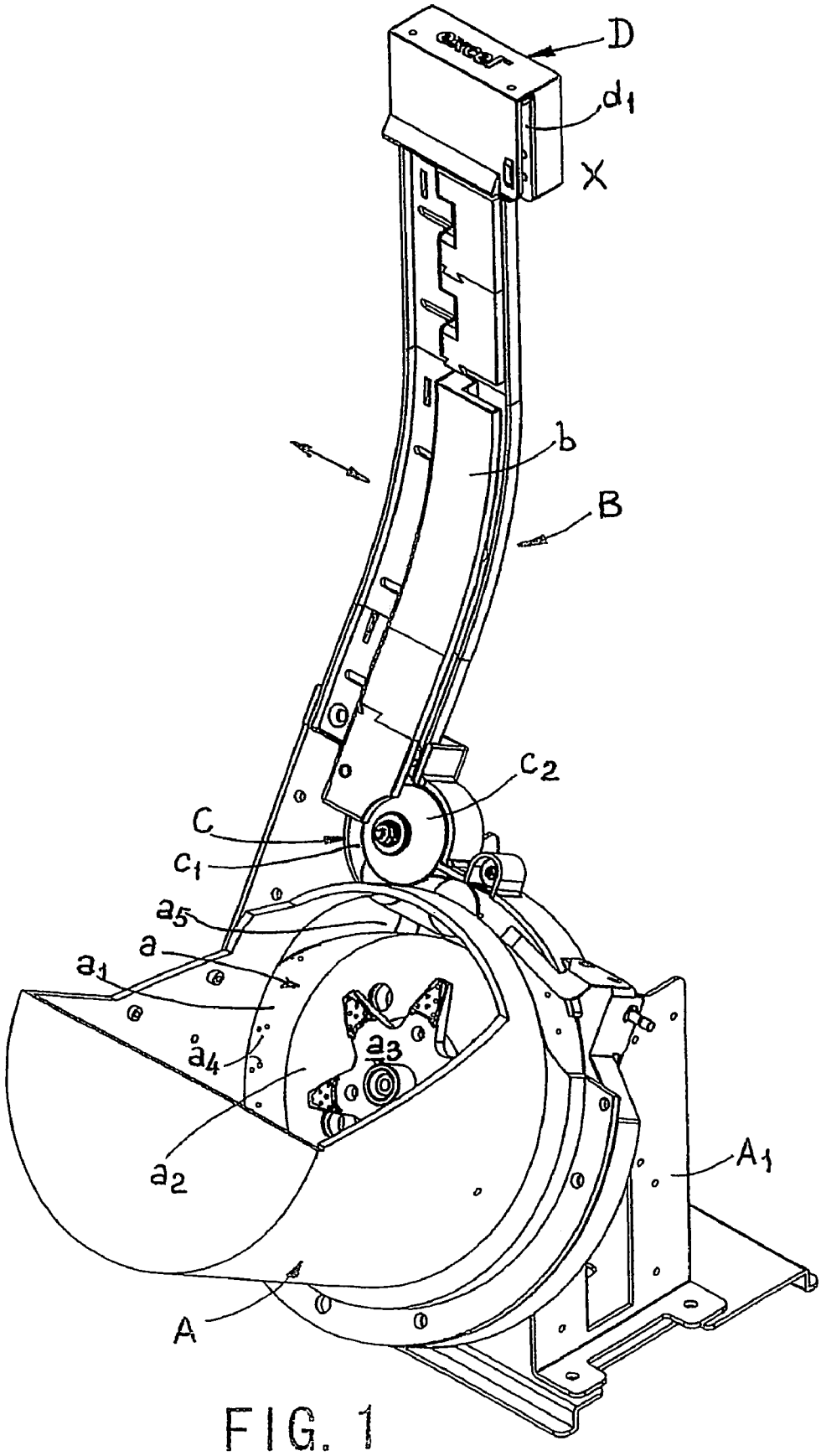
FIG. 1 is a perspective view of the complete device according to the invention, adapted for use in a game machine.

The device shown in FIG. 1 is a combination of a coin supply or storing reservoir A and a coin raising conveyor B with a transitional curved section C there between.

The coin reservoir A—also called "hopper"—is of a well-known type; it is mounted on a base A1 and has an inclined bottom plate a, which—as seen in the drawing—is adapted to be driven counter clock-wise by means of a drive motor (not shown). The bottom plate a has an annular outer portion a1 and a central disc-shaped portion a2 of a smaller diameter, the latter is taking a position that is elevated above the plane of the annular bottom plate portion a1 through an amount that is in the order of magnitude of the thickness of a coin to be handled. Furthermore the central bottom plate portion a2 carries a star-shaped coin mover a3 and the outer annular bottom plate portion a1 is provided with circumferencially spaced control pins a4.

In operation, with the reservoir A (partially) filled with coins and the bottom plate a rotating counter clock-wise (see FIG. 1), there is formed in the lower area of the reservoir, with the assistance of the coin mover a3, a ring of coins, which are caught between the control pins a4 and are lying flat on the outer annular bottom plate portion a1. The coins from this ring of coins are taken along and moved upwardly by the control pins a4 on the right side of the reservoir into the right upper quadrant, where the coins are supported with their circumferencial edges on the circumferencial edge of the central bottom plate portion a2 functioning as a support ledge. In the upper quadrant to the left in FIG. 1 there is provided a delivery knife a5. The coins arriving at the highest location on the outer annular bottom plate portion a1 are "stripped" by the knife a5 off the support ledge (circumferencial edge) of the central bottom plate portion a2 and then guided over the (at least) substantially horizontally extending upper edge of this knife so as to form a (substantially) horizontal coin flow which is tangentially directed relative to the support ledge of the central bottom plate portion a2. This coin flow is discharged from the coin reservoir A through a coin outlet opening under the influence of the pressure forces which are applied by the control pins a4 to the individual coins in the coin flow. The coin outlet opening is formed by a local interruption of the reservoir wall. The coin flow leaving the reservoir A is, at first, turned upwardly through an angle of about 90° within the plane of the annular bottom plate portion a1 before being pushed further upwardly through the coin raising conveyor B towards the delivery location X.

Figure 2A:
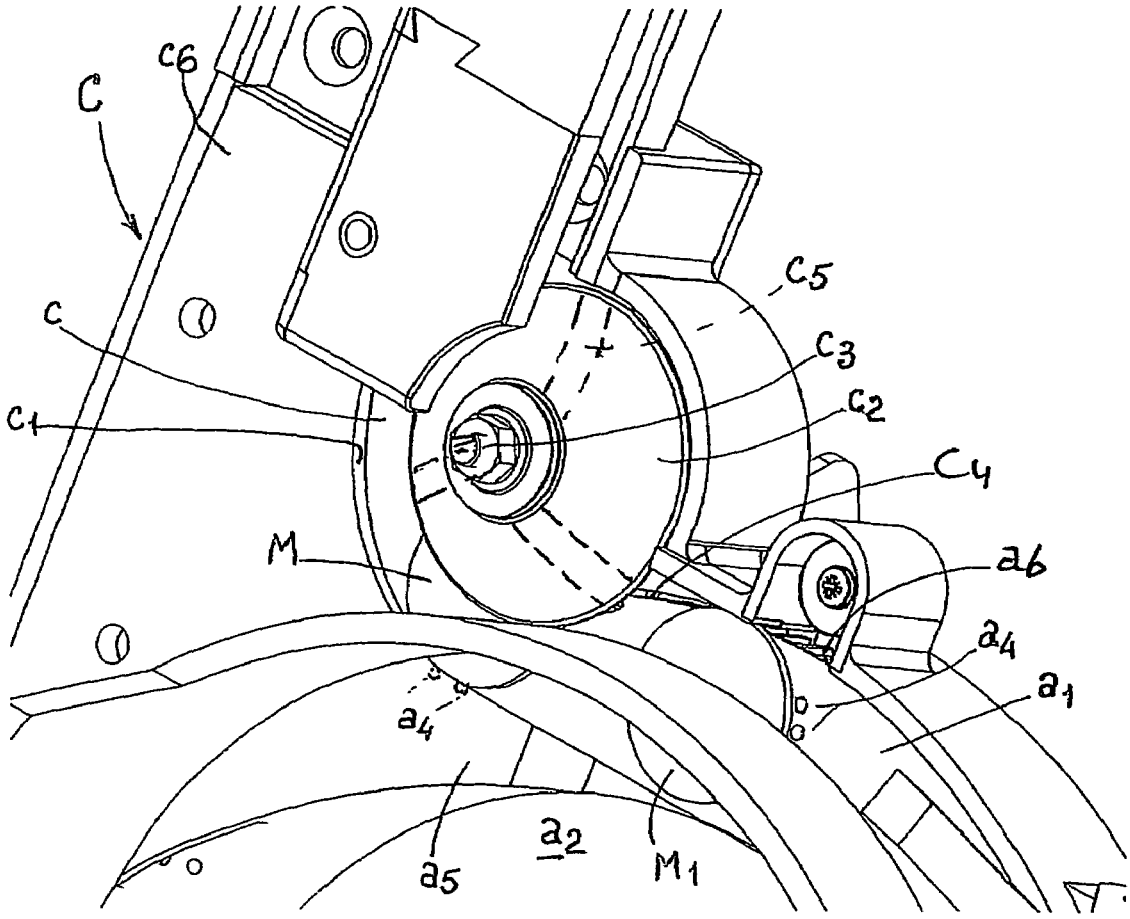
FIG. 2A is a perspective view on a larger scale of the curved section between the coin raising conveyor (escalator) and the coin reservoir (hopper)
Figure 2B:
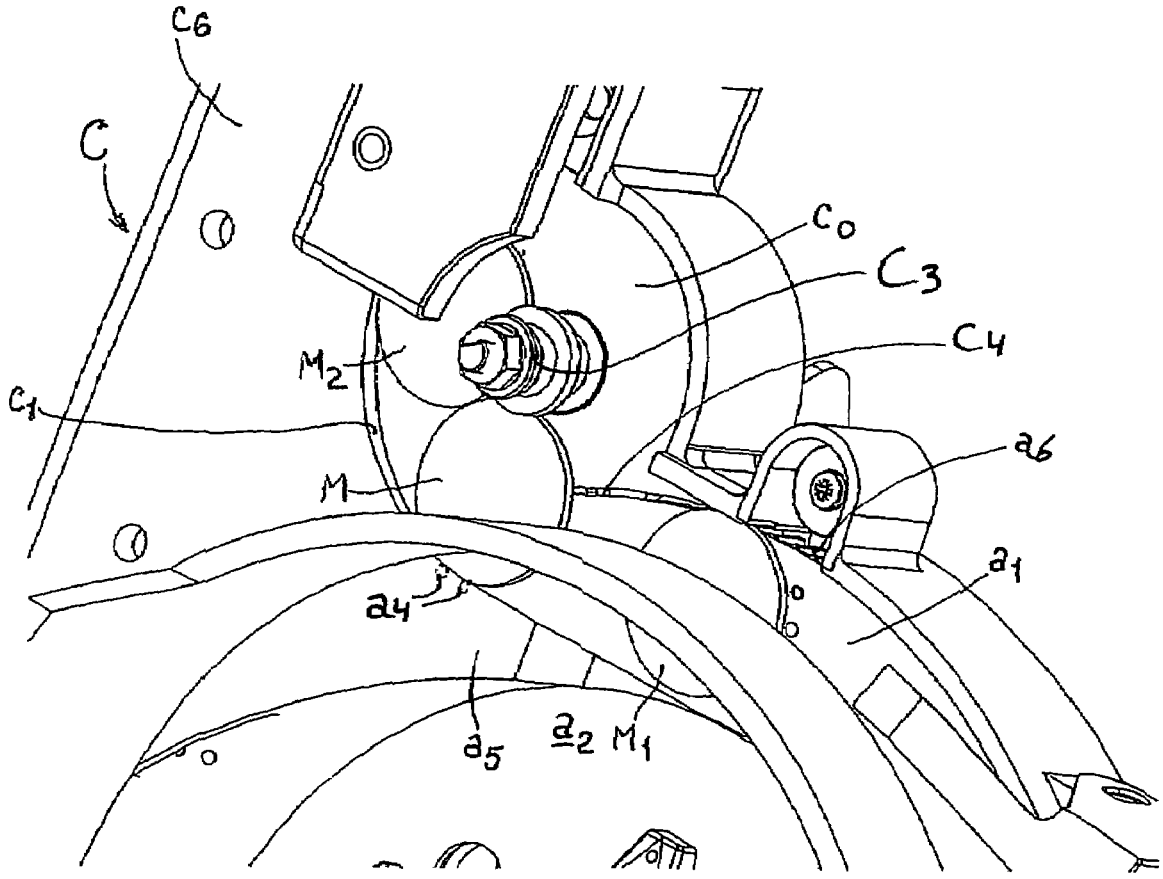
FIG. 2B is a view as represented in FIG. 2A, upon removal of the covering disc.

Turning the coin flow from the coin reservoir A upwardly through an angle of 90° is taking place within the curved section C, which may be further described below. At first reference is made to FIG. 2B, in which a curved section is shown which is completely open because the flexible disc-shaped covering wall of the invention is removed therefrom. FIG. 2B represents the moment at which the coin M has almost completely left the coin reservoir A and is about to loose its contact with the control pin a4 due to which it is no longer pushed up individually and therefore is about to fall back towards the next coin M1. It will be clear that this tendency to fall back is increased by the weight of the coin M2, that has become released from its control pin in an earlier stage and has almost "rounded the curve" while its circumferencial edge has become into contact with the circumferencial edge of the coin M. The result is, that the coins are raised shock-wise through the curved section C, so that there is the chance, that a coin looses its contact with its supporting base, as explained already herein above. This risk of "tipping up" of a coin in the curved section C will be greater according to the coin diameter being larger and the velocity at which the coins are discharged by the control pins a4 from the coin reservoir A being higher.

The curved section C has a bottom c with an outside bend wall C1 extending therefrom upwardly, which guides the coins towards the raising conveyor B (FIG. 1). To avoid the above described tendency of the coins to "tip up" a covering wall C2 is provided, according to the invention, at a certain distance over the bottom c, that keeps the coins which are moving through the curved section C in contact with the bottom c of the curved section C. The level of the covering wall C2 over the curved section bottom c is adapted or adjustable to the smallest coin diameter, whereas bent coins or coins of a larger thickness can pass as well because the covering wall c2 can yield due to its flexibility. To reduce friction between the disc-shaped covering wall c2 and the coins moving through the curved section C as much as possible, the covering wall is rotatably mounted about an axis c3 in the embodiment of FIG. 2A. Advantageously the flexible disc c2 is driven at a speed which is adapted to the speed at which the coins are travelling through the curved section C. To this end, as shown in FIGS. 2A and 2B, a part of the bottom c of the curved section C may be formed by a side of a gear c4, which is mounted on axis c3 and which is driven in a suitable transmission ratio by the annular portion a1 of the bottom plate of the coin reservoir A, said annular portion being therefore provided with gear teeth a6 at its outer circumference. As an alternative, instead of using such gear c4, the control arms or blades itself may engage such gear teeth a6. In fact a coin moving through the curved section is caught between two moving parts, viz. the gear c4 and the covering disc c2. In this way the friction to be overcome in the curved section is limited to a minimum.

As indicated by dashlines in FIG. 2A, blade-like protuberances c5 may be provided on the lower side of the rotary covering disc c2, which extend across a part of the height of the space between the curved section bottom c and the covering disc c2. With the assistance of such blades a completely uniform transfer of coins via the curved section C towards the raising conveyor B may be obtained. As an alternative the blades c5 may be formed either as a separate blade wheel c'5, as shown in FIG. 2C, or as blade-like protuberances on the gear c4.

Figure 2C:
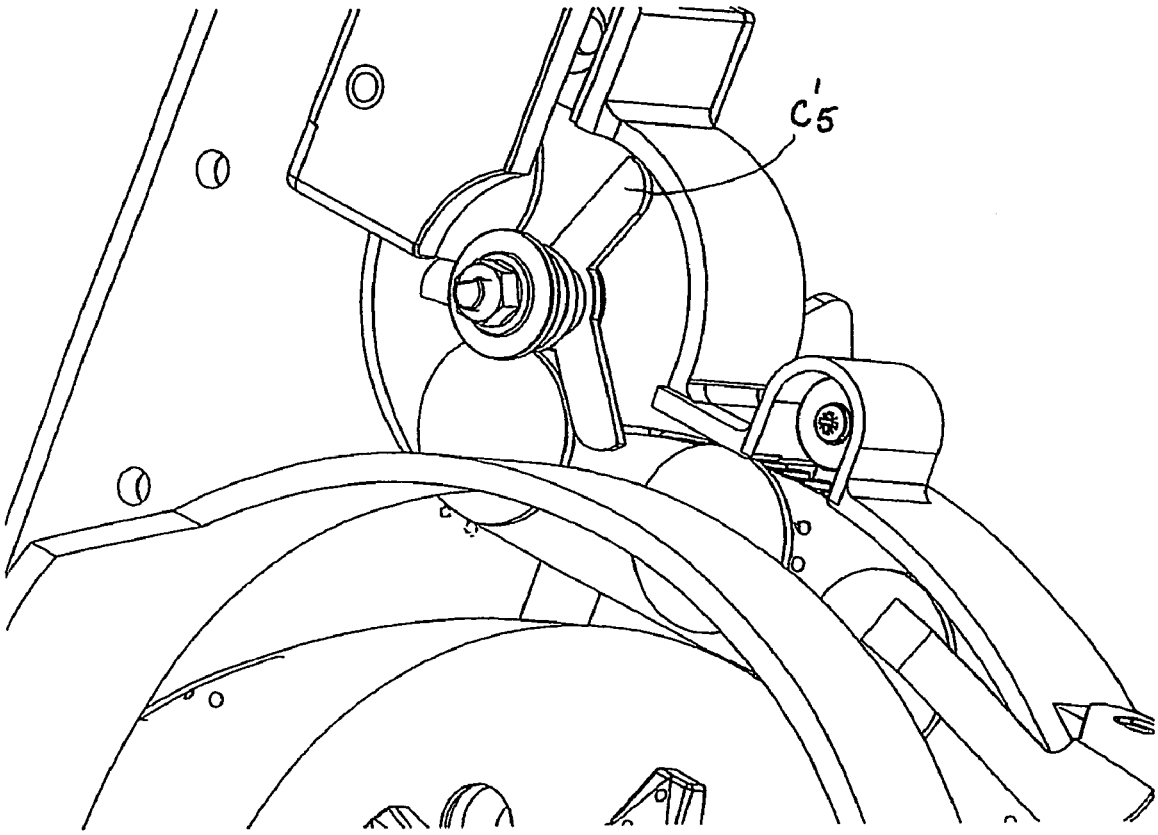
FIG. 2C is a perspective view of a curved section as represented in FIGS. 2A and 2B, wherein a separate blade wheel is used as an alternative, which blade wheel is positioned under the covering disc that is not shown in this drawing figure.
Figure 3:
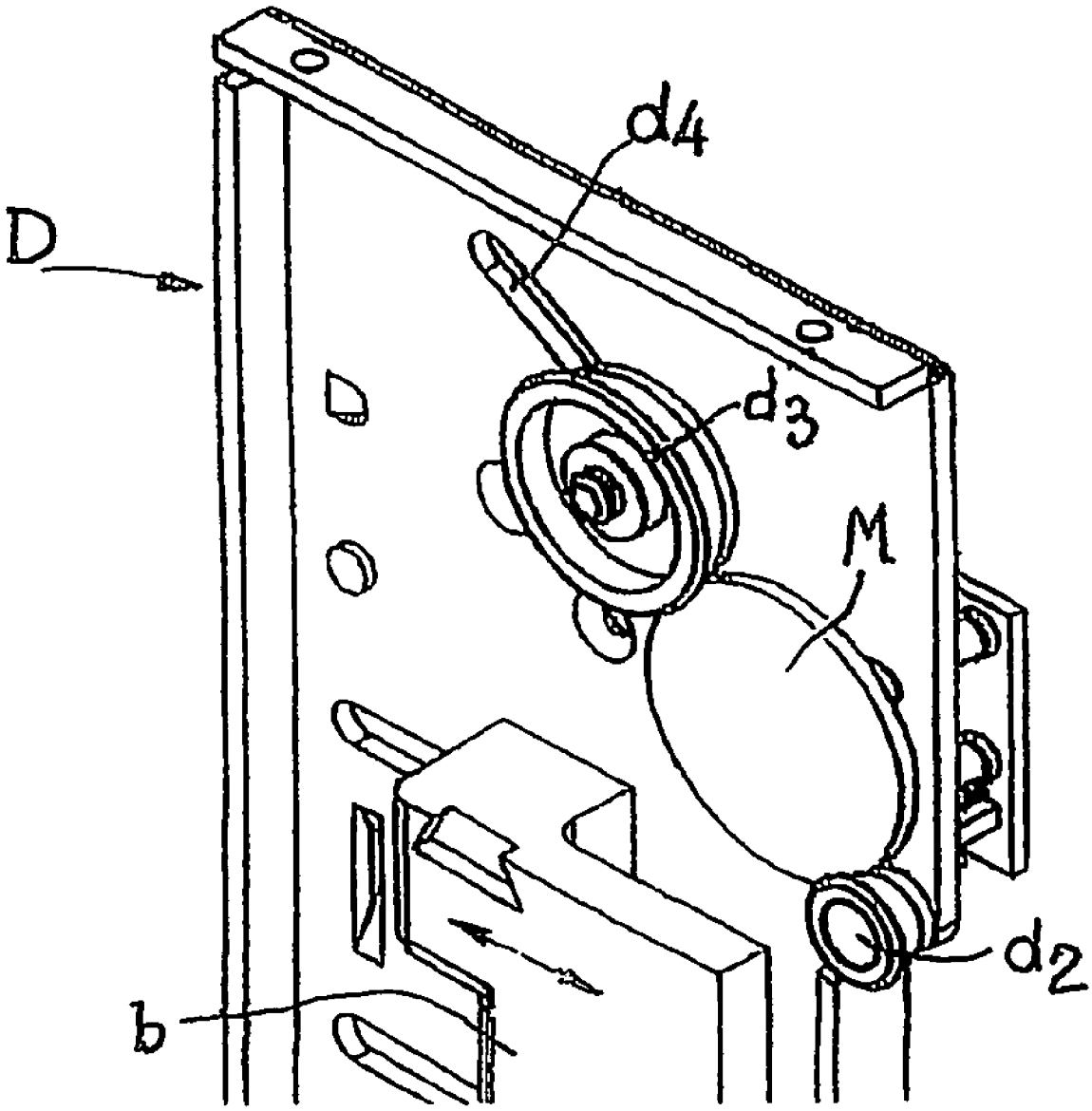
FIG. 3 is a perspective view of a detail of the upper end section of the coin raising conveyor.

In each of the cases represented in FIGS. 2A, 2B and 2C the outside bend wall C1 is obtained by putting on a flat base—of which the curved section bottom C is making part—a plate section c6 that in the example shown is integrally formed with the delivery knife a5.

Preferably the raising conveyor B is of the type described in EP document 0 950 989 and provided with a coin guiding passage with a bottom and side walls extending therefrom, which passage is covered by a covering strip that is planted with bristles.

By means of the described combination of the coin reservoir A, the raising conveyor B and the curved section C there between the coin supply from the coin reservoir A is transferred to a coin flow that uniformly moves via the curved section C and the raising conveyor B to the delivery location X. Variations in thickness, if any, such as caused by deformation, do not affect the uniform character of the coin flow.

The invention claimed is:

1. A device for dispensing disc-shaped objects comprising a coin storage reservoir with an inclined rotary bottom plate and provided with a coin outlet opening which is directed substantially tangentially relative to the top location of the bottom plate, said bottom plate being adapted to arrange the coins in the reservoir into a continuous flow of successive, flat lying coins and to push the coins from said flow, starting from the upper location of the rotary bottom plate, along a substantially straight path in a substantially horizontal direction one by one towards and through the coin outlet opening, and a conveyor for raising the coins from the level of the outlet opening of the coin storing reservoir to a delivery location, said conveyor comprising a trough-shaped coin guiding passage that is substantially formed by a passage bottom and two opposite side walls, said passage having at its lower end a curved section that is connected with said outlet opening, said curved section being adapted to receive the flow of coins discharged through the outlet opening of said reservoir in contact with the passage bottom and to bend the received flow of coins substantially through 90° towards a raising part of the coin guiding passage, a guiding means having an upper wall portion which is flexible relative to the passage bottom, and which extends over the passage bottom at a distance as to keep a passing coin in contact with the passage bottom, wherein the upper wall portion is disc-shaped, and the upper wall portion is mounted for rotation about an axis which is positioned adjacent the inside bend side wall of the curved section.

2. A device according claim 1, wherein under the disc-shaped upper wall portion a number of control arms is mounted for rotation about the axis of the upper wall portion, which arms extend substantially outwardly from said axis so as to extend, in operation, between the successive coins in that coin guiding passage, the side wall on the inside bend side of the coin guiding passage having a recess for allowing rotation of the control arms through the recess.

3. A device according to claim 1, wherein under the disc-shaped upper wall portion a number of control arms is mounted for rotation about the axis of the upper wall portion, which arms extend substantially outwardly from said axis so as to extend, in operation, between the successive coins in that coin guiding passage, the side wall on the inside bend side of the coin guiding passage having a recess for allowing rotation of the control arms through the recess, and the control arms are integrally formed with said disc-shaped upper wall portion and may yield along with said upper wall.

4. A device according to claim 1, wherein under the disc-shaped upper wall portion a number of control arms is mounted for rotation about the axis of the upper wall portion, which arms extend substantially outwardly from said axis so as to extend, in operation, between the successive coins in that coin guiding passage, the side wall on the inside bend side of the coin guiding passage having a recess for allowing rotation of the control arms through the recess, and the control arms respectively are forming a separate gear or blade wheel respectively, which is mounted to be driven in synchronism with the rotary bottom plate of the coin storing reservoir.

5. A device according to claim 1, wherein on the axis having mounted thereon the disc-shaped upper wall portion of the curved section of the coin guiding passage there is mounted a drive gear, and in that the rotary bottom plate of the reservoir is provided with gear teeth which engage said drive gear.

6. A device according to claim 1, wherein under the disc-shaped upper wall portion a number of control arms is mounted for rotation about the axis of the upper wall portion, which arms extend substantially outwardly from said axis so as to extend, in operation, between the successive coins in that coin guiding passage, the side wall on the inside bend side of the coin guiding passage having a recess for allowing rotation of the control arms through the recess, and on the axis having mounted thereon the disc-shaped upper wall portion of the curved section of the coin guiding passage there is mounted a drive gear, and in that the rotary bottom plate of the reservoir is provided with gear teeth which engage said drive gear.

7. A device according to claim 1, wherein under the disc-shaped upper wall portion a number of control arms is mounted for rotation about the axis of the upper wall portion, which arms extend substantially outwardly from said axis so as to extend, in operation, between the successive coins in that coin guiding passage, the side wall on the inside bend side of the coin guiding passage having a recess for allowing rotation of the control arms through the recess, and the control arms are integrally formed with said disc-shaped upper wall portion and may yield along with said upper wall, and on the axis having mounted thereon the disc-shaped upper wall portion of the curved section of the coin guiding passage there is mounted a drive gear, and in that the rotary bottom plate of the reservoir is provided with gear teeth which engage said drive gear.

8. A device according to claim 1, wherein under the disc-shaped upper wall portion a number of control arms is mounted for rotation about the axis of the upper wall portion, which arms extend substantially outwardly from said axis so as to extend, in operation, between the successive coins in that coin guiding passage, the side wall on the inside bend side of the coin guiding passage having a recess for allowing rotation of the control arms through the recess, and the control arms are integrally formed with said disc-shaped upper wall portion and may yield along with said upper wall, and on the axis having mounted thereon the disc-shaped upper wall portion of the curved section of the coin guiding passage there is mounted a drive gear, and in that the rotary bottom plate of the reservoir is provided with gear teeth which engage said drive gear, and a portion of the curved section of the coin guiding passage is formed by a side of a gear which is mounted on an axis of the disc-shaped upper wall portion.

* * * * *